US005984441A

United States Patent [19]

Stokhuijzen

[11] Patent Number: 5,984,441

[45] Date of Patent: Nov. 16, 1999

[54] MODULAR STORAGE AND TRANSPORTATION SYSTEM OF TOOLS AND MATERIALS

[76] Inventor: Michiel Frederik Stokhuijzen, Billitonstraat 15, Den Haag, Netherlands, 2585 TX

[21] Appl. No.: 08/930,806

[22] PCT Filed: Feb. 10, 1997

[86] PCT No.: PCT/NL97/00048

§ 371 Date: Oct. 8, 1997

§ 102(e) Date: Oct. 8, 1997

[87] PCT Pub. No.: WO97/28931

PCT Pub. Date: Aug. 14, 1997

[30] Foreign Application Priority Data

Feb. 9, 1996 [NL] Netherlands ..... 1002290

[51] Int. Cl.[6] ..... A47B 85/00

[52] U.S. Cl. ..... 312/240; 312/249.7; 312/248; 211/2; 211/96

[58] Field of Search ..... 301/248.7, 248, 301/199, 201; 211/96, 168, 169, 2; 206/287.1; 312/300, 308, 244, 249.7, 901, 199, 201, 248, 111

[56] References Cited

U.S. PATENT DOCUMENTS

| | | | |
|---|---|---|---|
| 757,003 | 4/1904 | Wilcox | 211/169 |
| 2,339,627 | 1/1944 | Edison | 312/199 |
| 4,304,382 | 12/1981 | Jelen . | |
| 4,569,488 | 2/1986 | Graham | 211/169 |
| 4,765,470 | 8/1988 | Curci . | |
| 4,971,234 | 11/1990 | Hay . | |
| 5,080,240 | 1/1992 | Williams . | |
| 5,217,115 | 6/1993 | Purkapile . | |
| 5,415,255 | 5/1995 | Hafner . | |

FOREIGN PATENT DOCUMENTS

| | | | |
|---|---|---|---|
| 0 274 549 | 7/1988 | European Pat. Off. . | |
| 0 319 969 | 6/1989 | European Pat. Off. . | |
| 0 566 983 | 10/1993 | European Pat. Off. . | |
| 42 28 370 | 3/1993 | Germany . | |
| 2928267 | 1/1981 | United Kingdom | 206/387.1 |
| 2 270 066 | 3/1994 | United Kingdom . | |
| WO 90/08631 | 8/1990 | WIPO . | |
| WO 93/04703 | 3/1993 | WIPO . | |

*Primary Examiner*—Peter M. Cuomo
*Assistant Examiner*—Gerald A Anderson
*Attorney, Agent, or Firm*—Michaelson & Wallace; Peter L. Michaelson

[57] ABSTRACT

A module is provided with a plane, tools can be fixed on both sides of the plane. The module can be positioned in either a coupled position in which the module is coupled to an adjacent module, or a hanging position in which the module is secured to a wall, the module includes a coupling device. The coupling device permits, when in the coupled position, multiple modules to be ordered in any sequence such that each of the multiple modules can pivot with respect to an adjacent module. The coupling device supports the separate module when the module is in the hanging position, the module is pivotable about an axis defined by a wall mounted holder.

16 Claims, 4 Drawing Sheets

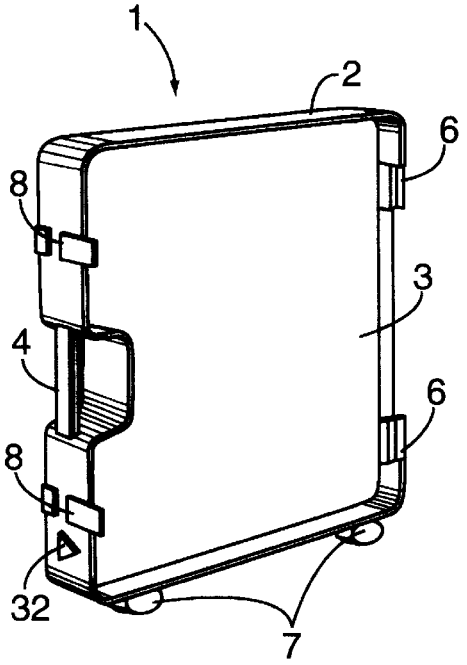
FIG. 1
FIG. 2
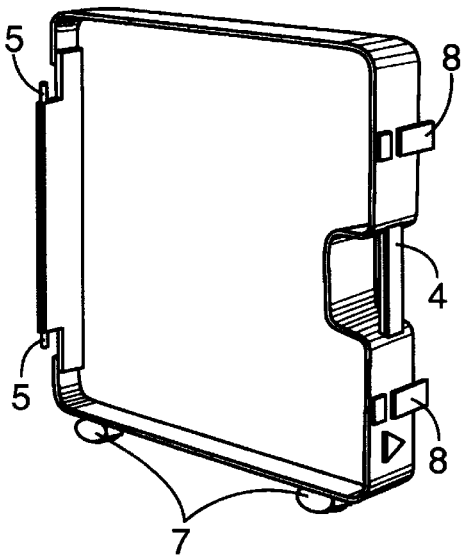
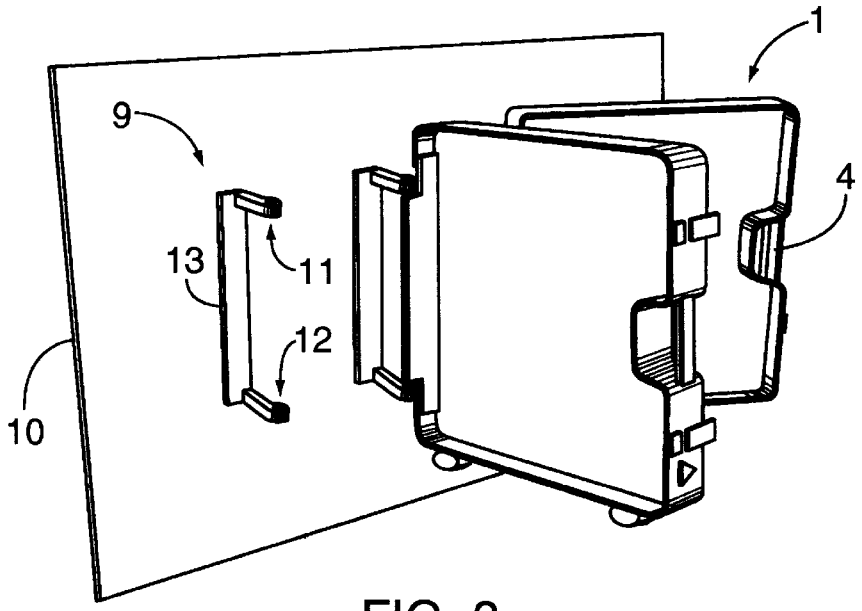
FIG. 3

FIG. 8
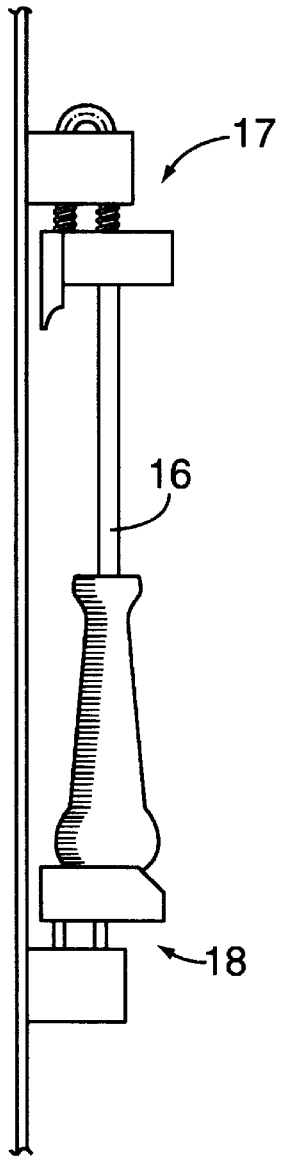
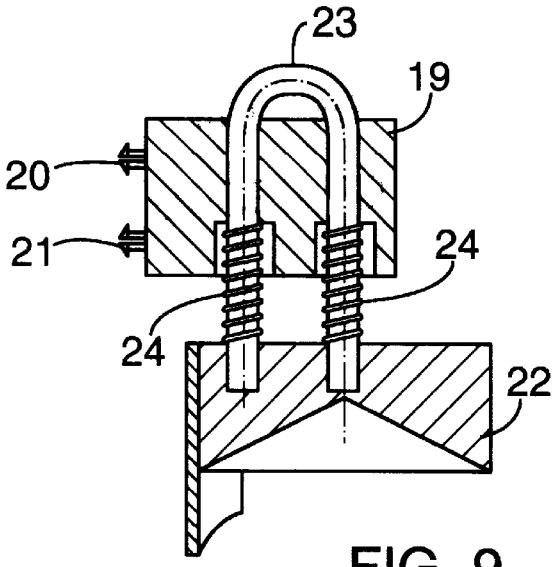
FIG. 9
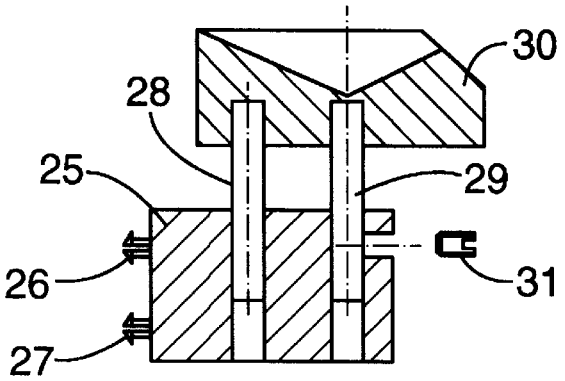
FIG. 10

MODULAR STORAGE AND TRANSPORTATION SYSTEM OF TOOLS AND MATERIALS

BACKGROUND OF THE INVENTION

1. Field of the Invention

The invention concerns a device for storage and transport of tools and materials, consisting of modules, as described in the first part of claim no. 1.

2. Description of the related Art

Many systems for storage and transport of tools are known. There are metal toolboxes that can be characterized by a limited overview of the content and a high weight. There are plastic toolboxes with a division in compartments and trays that characteristically have a limited overview and a limited capacity. Finally there are toolboxes in which the tools are not stored in trays, but are fixed onto boards in an organized way, often by means of sleeve pockets, clamps or straps. These boxes have a limited capacity and are not easy to use for heavy tools, because the boards are then difficult to move over or because the the box will then overturn or fall shut. There also exist extendable, modular systems, as described in patents DE-A 42.28.370, DE-U 92.055.444 and DE-U 93.16.16.766. As opposed to the present invention, the content of the modules of the abovementioned systems is accesible only after the modules have been disconnected. The modularity or extendability is exclusively aimed at transportation and not at utilisation. Other patents regarding toolboxes concern a number of modules that can rotate or pivot with respect to each other, as in the patents U.S. Pat. No. 5,259,502, DRE-U 91.02.718, CH-A 447.075, U.S. Pat. No. 4,998,616, WO 90/08631 and EP 0.319.969, but these patents do not include the possibility to easily couple any number of modules that can pivot with respect to each other, nor do they include the possibility to mount the modules separately to the wall, in such a way that they can swung around.

Another modular system is known according to patent EP-A 0566.983. This system has great limitations for the user. Coupling and uncoupling of the modules is done by using a loose shaft, so that one cannot speak of an easy (un)coupling of the modules. A unit, composed of modules. Is meant to be used laying flat. If the modules on top contain heavy tools or materials, this leads to backward topping over of the unit.

In addition, these heavy modules must be lifted every time the content of the modules underneath must be reached.

Besides the abovementioned types of boxes, boards and cupboards are used for the storage of tools. These are boards or cupboards with perforated planes, on which toolclamps can be fixed. The tools are fixed in a well-organised manner, but they use a large wall surface area and are not ready for transport.

A do-it-yourselfer, a carpenter or a mechanic who uses his tools at home respectively in his workshop as well as elsewhere, wants a storage system for his tools that is well organised and has sufficient capacity, so that he can store all his tools in it and can find each tool easily. A user with few tools does not need much storage capacity, and wants a compact, but extendable, system. Someone who works at home or in a workshop, and also goes out to do jobs elsewhere, wants a storage system for his tools that remains well-organised in all situations. He wants to fix his tools to the wall above his workbench at home so that his doesn't have to bend down during work. Going to a job, he only wants to take the tools he needs, because he doesn't like to carry too many tools in view of the generally high weight. At the jobsite, he wants a compact and well-organised unit, in which he can find his tools easily without going through trays full of tools. When the job is done, he wants to store his tools at home directly, without having to fix each tool separately.

BRIEF SUMMARY OF THE INVENTION

The invention is aimed at providing a system for storage and transportation of tools and materials that is compact, well-organised and accessible under all circumstances, and the capacity of which can easily be adapted.

According to the invention, this is achieved by the possibility to couple modules in such a way that they can pivot with respect to each other, while at the other hand they can be hung on the wall separately, whereas each module has a plane on which tools or materials can be fixed from both sides.

According to another aspect of the invention, described in claim no. 2, coupling of the modules can be done in a user-friendly manner, so that it is possible to assemble a compact mobile unit, containing the right tools for a certain job, easily and quickly.

At the bottom edge, perpeddicular to the backside edge that contains the pivot mechanism, each module may be equiped with small castors or elements of comparable function, so that when a number of modules is assembled to form a unit, the unit is moveable as a cart. When the unit is used as a standing book, the cantor wheels allow easy movement of the modules with respect to each other, so that each module is easily accesible from both sides. A unit, consisting of one or more modules, can be closed by means of covers to protect the content from environmental influences and from damage. Each module can be equiped with a handle in such a way, that an assembled unit can be carried with one hand. After completion of a job, using a unit assembled of a number of modules, the user can disassemble the unit at home or in the workshop easily, and hang the modules on the wall separately besides each other. Because of the two-sided use of the modules, a large number of tools can be stored on a relatively small wall surface, maintaining overview and accesibility. The tools can be fixed to the plane of the modules by means of suitable clamps or, more specifically, by means of a clamping system that holds each tool between two concave shoes or holders while clamping it axially through spring action.

The invention will be explained in more detail using a number of design examples.

BRIEF DESCRIPTION OF THE FIGURES

FIG. 1 shows a design of a module with a centrally positioned main surface, also called plane. a handle, two castors, closures and a pivot that can be coupled.

FIG. 2 shows the other side of the module, with the counterpart of the connectable pivot.

FIG. 3 shows two modules, hung on the wall in a pivotable way by means of a module-holder.

FIG. 8 shows the axial clamping system for tools or materials, consisting of a top holder and a lower holder.

FIG. 9 shows the top holder with snap fingers, spring and concave shoe.

FIG. 10 shows the lower holder with height adjustment and concave shoe.

DETAILED DESCRIPTION OF THE INVENTION

Figure 4:
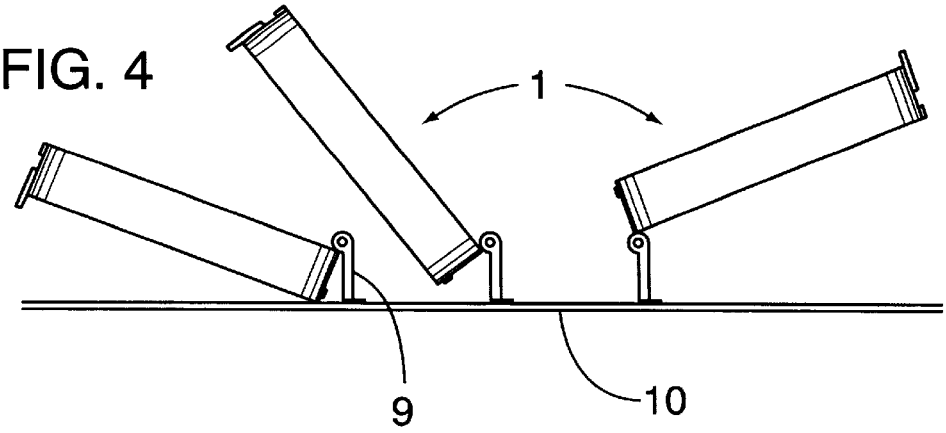
FIG. 4 shows a top view of the modules on the wall.

In FIGS. 1 and 2 a possible version of module 1 is shown that is the basis of the system. The module is a case-like product consisting of an edge 2 containing a perforated plane 3 positioned centrally in the module, so that tools can be fixed on both sides of it. The module is rectangular with two long sides and two short sides. One long side has a handle and on the opposite side is the pivot joint that consists of two shafts 5 and two times a casing 6.

Figure 5:
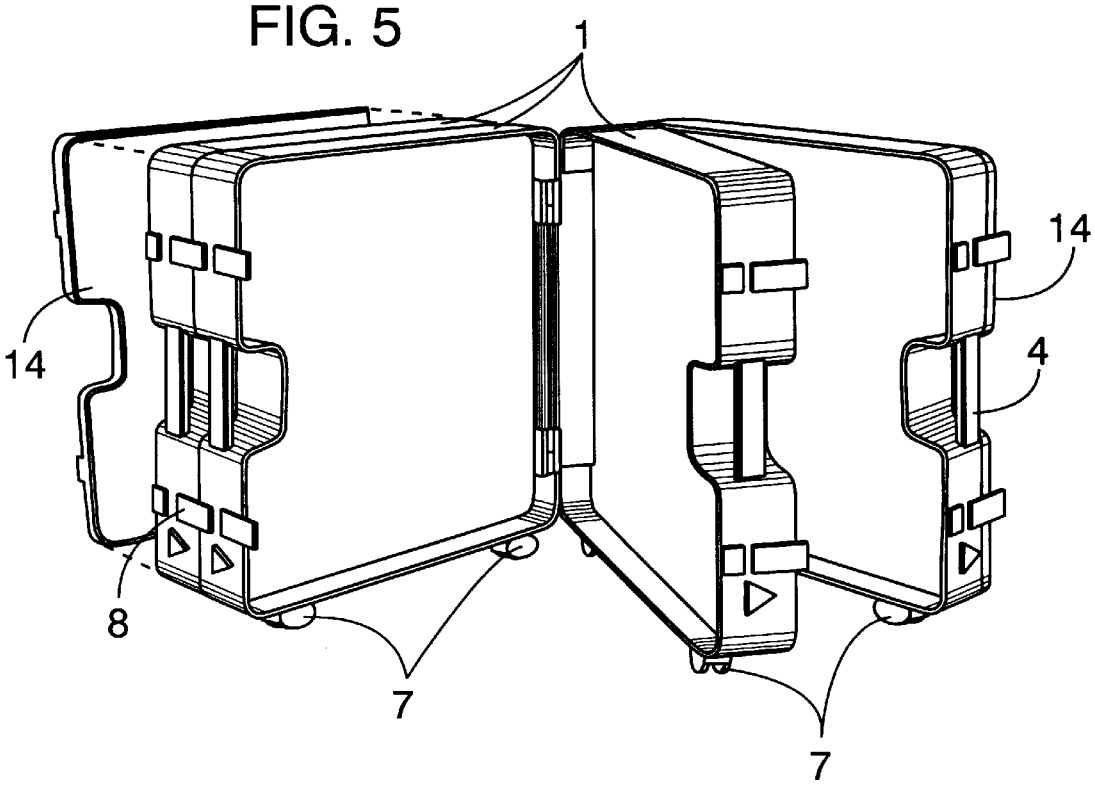
FIG. 5 shows a number of modules, coupled to form a unit for modile use, equiped with covers.
Figure 6:
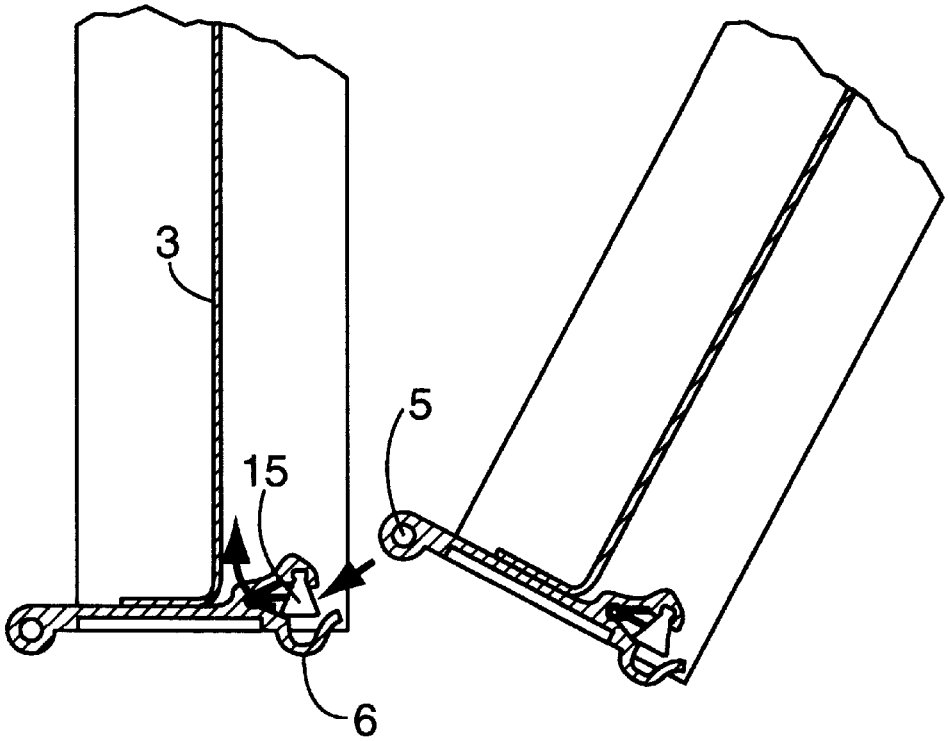
FIG. 6 shows a section of the pivot in detail; the coupling of the modules.
Figure 7:
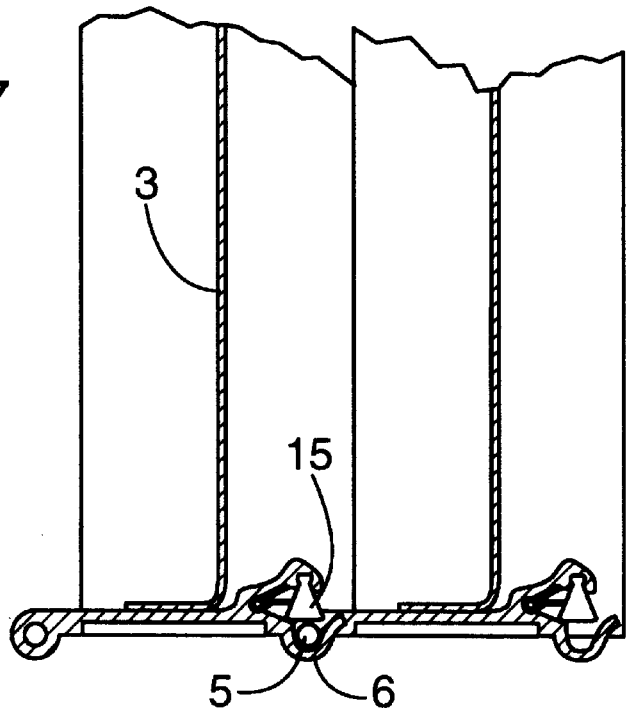
FIG. 7 shows a detail of the pivot in section; the modules are coupled.

The casing 6 is a part of the edge of the module. The lower side of the module is equiped with castors 7. Besides handle 4, two closures 8 are mounted. When hanging the modules on the wall in such a way that they can pivot, as shown in FIGS. 3 and 4, pivot-shaft 5 is used. The shafts are engaged in a module holder 9, that is fixed to the wall 10. The module holder 9 has two conical holes 11 and 12, whereas 12 is less deep than 11. The module holder can be fixed to the wall by means of a wall plate 13. The modules are now hung On the wall in such a way that they can pivot, and tools or materials can be fixed to the from both sides. Handle 4 can now be used to turn the modules and to remove the modules from the wall. FIGS. 5, 6 and 7 refer to the mobile status of the system. In FIG. 5, the modules 1 are coupled through the pivots. A unit is created that can be carried like a case. The outer modules can be closed by means of covers 14. The coupled modules can be locked to each other by means of closures 8 that are mounted on each module. Because castors 7 are under each module, the unit is can be rolled along. FIG. 6 shows a side view of how the modules are coupled. One module is put on the ground with the handle on top. The next module is held beside it and the pivot shafts 5 are positioned in the pivot casings 6, after which two sprung cams 15 take care of the coupling. The cam 15 turns away when the pivot shaft 5 is inserted into the casing 6. After shaft 5 has reached its end position, cam 15 returns to its initial position by means of a spring. The pivoting connection is now secured. The disengagement of the pivot is realised by letting cam 15 turn away through a mechanism, activated by button 32. FIGS. 8, 9 and 10 refer to the axial clapping system. The tools 16 are held in a tool clamp consisting of two holders 17 and 18.

The tool holders are fixed to the perforated plane 3 by means of snap fingers. FIG. 9 shows the top holder 17, FIG. 10 shows the lower holder 18. The top holder consits of a concave shoe 22 that is connected through a straight guidance to a guiding block 19 by means of calliper 23. The guiding block 19 is fixed to the perforated surface 3 by means of two snap fingers 20 and 21. The guiding block 19 can be moved up and down with respect to calliper 23. Two springs 24 deliver the spring force for the system. The lower holder 18 consists of a shoe 30, comparable to 22 to the extent that this shoe 30 is bevelled at the front side. In the shoe 30, two shafts 28 and 29 are mounted, that take care of a straight guidance in guiding block 25. Just as guiding block 19, the guiding block 25 can be fixed to plane 3 by means of snap fingers 26 and 28. The lover holder 18 has no springs, but is adjustable in height by means of adjusting bolt 31, so that the above described clamping of the tools can also be applied otherwise.

I claim:

1. An apparatus comprising:

a module provided with a plane on which tools can be fixed on both sides thereof, the module can be positioned in either a coupled position in which the module is coupled to an adjacent module such that the module and the adjacent module may be carried, or a hanging position in which the module is secured to a wall, the module comprising a coupling device;

the coupling device permits, when the module is in the coupled position, a plurality of said modules to be ordered in any sequence such that each of the plurality of said modules can pivot with respect to an other module; and the coupling device supports the separate module when the module is in the hanging position, the module is pivotable about an axis defined by a wall mounted holder.

2. The apparatus set forth in claim 1, the module further comprising:

a first edge extending around a periphery of the module, wherein when the module is in a coupled position, when the first edge contacts a second edge defined on the adjacent module, the first module and the second module are in a closed position; and a lock device which can lock the first edge to the second edge when the modules are in the closed position.

3. The apparatus set forth in claim 4, further comprising a wall plate mounted to a wall, the pivot shaft can be inserted into, and secured within, the wall plate such that the first module can pivot relative to the wall.

4. The apparatus set forth in claim 1, wherein the coupling device further comprises a pivot shaft fixed to an edge of the module.

5. The apparatus set forth in claim 4, further comprising a pivot casing fixably attached to the edge of the adjacent module, the pivot shaft being inserted into the pivot casing of the adjacent module at which time the module can pivot relative to the adjacent module.

6. The apparatus set forth in claim 5, wherein when the first module pivots relative to the second module such that the first edge contacts the second edge, then the first module and the second module are in a closed position.

7. The apparatus set forth in claim 5, the pivot casing displaceable between a first casing position and a second casing position, the pivot shaft can be inserted into and removed from within the pivot casing when the pivot casing is in the first casing position, and the pivot shaft is secured within the pivot casing when the pivot casing is in the second casing position and the pivot shaft is within the pivot casing.

8. The apparatus set forth in claim 7, the pivot casing further comprising a cam displaceable between a first cam position and a second cam position, wherein when the cam is in the first cam position the pivot casing is in the first casing position, and when the cam is in the second cam position the pivot casing is in the second casing position.

9. The apparatus set forth in claim 8, the pivot casing further comprising spring means for biasing the cam from the first cam position into the second cam position.

10. The apparatus set forth in claim 1, further comprising a clamping device affixed to the first plane, the clamping device secures a tool to the plane.

11. The apparatus set forth in claim 10, the tool clamping device further comprising:

a first holder securing a first portion of the tool; and a second holder securing a second portion of the tool, the second holder displaceable between a first holder position and a second holder position, when the second holder is in the first holder position then the first tool holder and the second tool holder are capable of securing the tool, when the second holder is in the second holder position then the tool may be inserted within, or removed from between, the first holder and the second holder.

12. The apparatus set forth in claim 1, further comprising a castor attached to the module.

13. The apparatus set forth in claim 1, further comprising a handle fixed to the module.

14. The apparatus set forth in claim 1, the first module further comprises an edge, the edge is substantially rectangular in shape.

15. The apparatus set forth in claim 1, wherein, when in the coupled position, a module and an adjacent module can be pivoted into a closed position in which a first edge of the module contacts a second edge of the adjacent module, when the module and the adjacent module are in the closed position they can be locked into a locked position; and wherein, when the module is in the locked position, the edge of the module is configured to a dimension such that tools secured between the plane of the module and the plane of the adjacent module are limited from contacting each other.

16. The apparatus set forth in claim 1, further comprising:

the coupling device including a pivot shaft located on the module and a pivot casing located on the adjacent one of said modules;

wherein when in the coupled position with an adjacent module, the module can pivot with respect to an adjacent module and the pivot shaft of the module is inserted in the pivot casing of the adjacent module; and the pivot casing comprises a cam, the cam is displaceable between a first position where the pivot shaft may be removed from the pivot casing of the adjacent module, thereby causing the module and the adjacent module to no longer be in the coupled position, and a second position where the pivot shaft is locked into the coupled position with an adjacent module.

* * * * *